US005165863A

United States Patent [19]

Taguchi

[11] Patent Number: 5,165,863

[45] Date of Patent: Nov. 24, 1992

[54] SLANT PLATE TYPE COMPRESSOR WITH VARIABLE CAPACITY CONTROL MECHANISM

[75] Inventor: Yukihiko Taguchi, Isesaki, Japan

[73] Assignee: Sanden Corporation, Gunma, Japan

[21] Appl. No.: 791,254

[22] Filed: Nov. 13, 1991

[30] Foreign Application Priority Data

Nov. 16, 1990 [JP] Japan ..... 2-308815

[51] Int. Cl.[5] ..... F04B 1/28

[52] U.S. Cl. ..... 417/222.2; 417/270

[58] Field of Search ..... 417/222 R, 222 S, 270

[56] References Cited

U.S. PATENT DOCUMENTS

| | | | |
|---|---|---|---|
| 4,231,713 | 11/1980 | Widdowson et al. | 417/222 |
| 4,526,516 | 7/1985 | Swain et al. | 417/222 |
| 4,533,299 | 8/1985 | Swain et al. | 417/222 |
| 4,606,705 | 8/1986 | Parekh | 417/222 S |
| 4,688,997 | 8/1987 | Suzuki et al. | 417/222 |
| 4,730,986 | 3/1988 | Kayukawa et al. | 417/222 |
| 4,747,753 | 5/1988 | Taguchi | 417/222 |
| 4,780,059 | 10/1988 | Taguchi | 417/270 X |
| 4,842,488 | 6/1989 | Terauchi | 417/222 |
| 4,913,626 | 4/1990 | Terauchi | 417/222 |
| 5,051,067 | 9/1991 | Terauchi | 417/222 |
| 5,094,589 | 3/1992 | Terauchi et al. | 417/222 S |

FOREIGN PATENT DOCUMENTS

| | | |
|---|---|---|
| 60-162087 | 8/1985 | Japan . |
| 61-55380 | 3/1986 | Japan . |
| 2153922A | 8/1985 | United Kingdom . |

*Primary Examiner*—Leonard E. Smith
*Attorney, Agent, or Firm*—Baker & Botts

[57] ABSTRACT

A slant plate type compressor having a capacity or displacement adjusting mechanism includes a housing for a cylinder block provided with a plurality of cylinders and a crank chamber. A piston is slidably fitted within each of the cylinders and is reciprocated by a drive mechanism which includes a slant plate having a surface with an adjustable incline angle. The incline angle of the slant plate, and thus the capacity of the compressor, is controlled according to the pressure differential between the crank chamber and the suction chamber. The pressure in either the crank chamber or the suction chamber is controlled by an externally controlled valve mechanism which is disposed in a passageway linking the crank chamber and the suction chamber. An internally controlled safety valve device prevents an abnormal pressure differential between the crank and suction chambers. The internally controlled safety valve device is provided within the externally controlled valve mechanism, thereby obtaining an easily manufactured slant plate type compressor having a capacity adjusting mechanism with a safety valve device.

22 Claims, 6 Drawing Sheets

SLANT PLATE TYPE COMPRESSOR WITH VARIABLE CAPACITY CONTROL MECHANISM

BACKGROUND OF THE INVENTION

1. Technical Field

The present invention relates to a refrigerant compressor, and more particularly, to a slant plate type compressor, such as a wobble plate type compressor, having a variable displacement mechanism which is suitable for use in an automobile air conditioning system.

2. Description of the Prior Art

Slant plate type piston compressors including variable displacement or capacity adjusting mechanisms for controlling the compression ratio of a compressor in response to demand are generally known in the art. For example, Japanese Utility Model Application Publication No. 63-134181 discloses a wobble plate type compressor including a cam rotor driving device and a wobble plate linked to a plurality of pistons. Rotation of the cam rotor driving device causes the wobble plate to nutate and thereby successively reciprocate the pistons in the corresponding cylinders. The stroke length of the pistons and thus the capacity of the compressor may be easily changed by adjusting the slant angle of the wobble plate. The slant angle is changed in response to the pressure differential between the suction chamber and the crank chamber.

In the above-mentioned Japanese Utility Model Application Publication, the crank chamber and the suction chamber are linked in fluid communication by a first path or passageway. A valve mechanism is disposed in the first passageway in order to control fluid communication between the crank and suction chambers by the opening and closing of the first passageway. The valve mechanism generally includes a solenoid, a plunger and a valve member disposed on one end of the plugner. The solenoid receives two external signals, one of which represents the heat load on an evaporator of a cooling circuit and another which represents the amount of demand for accelerating an automobile.

The solenoid induces various electromagnetic forces in response to changes in the two external signals and thereby changes the axial position of the plunger so that the first passageway is opened and closed by the valve member. Hence, the angular position of the wobble plate is varied in a range from the maximum to the minimum slant angles responsive to changes in the two external signals such that the capacity displacement of the compressor is thereby adjusted and the suction chamber pressure is maintained at a predetermined constant value.

The compressor further includes a second passageway, separate from the first passageway, and communicating the crank chamber with the suction chamber. A safety valve device including a ball member and a coil spring elastically supporting the ball member is disposed in the second passageway. The safety valve device opens and closes the second passageway in response to changes in the pressure differential between the crank chamber and the suction chamber. The second passageway is opened when the pressure differential between the crank chamber and the suction chamber exceeds a predetermined value. Therefore, when communication between the crank chamber and the suction chamber is blocked for a long time period of time due to trouble in the valve mechanism, thereby causing an abnormal rise in the crank chamber pressure because of blow-by gas leaking past the pistons in the cylinders as the pistons reciprocate, the second passageway is opened so as to forcibly and quickly reduce the crank chamber pressure and thereby prevent an abnormal pressure differential between the crank and suction chambers. As a result, excessive friction between the internal component parts of the compressor caused by the abnormal differential between the crank chamber and the suction chamber can be prevented.

In this prior art embodiment, however, the second passageway is separate from the first passageway such that the process of forming the second passageway and the process of disposing the safety valve device in the second passageway are additional steps required during the manufacturing of the compressor. Accordingly, the manufacturing process of the compressor is complicated by this requirement.

Therefore, a strong need exists for a compressor having a variable displacement control mechanism which can be easily manufactured and which can prevent an abnormal pressure differential between the crank chamber and the suction chamber.

SUMMARY OF THE INVENTION

A slant plate type refrigerant compressor including a compressor housing enclosing a crank chamber, a suction chamber and a discharge chamber therein is disclosed. The compressor housing includes a cylinder block having a plurality of cylinders formed therethrough, and a piston slidably fitted within each of the cylinders. A drive mechanism is coupled to the pistons for reciprocating the pistons within the cylinders. The drive mechanism includes a drive shaft rotatably supported in the housing and a coupling mechanism which drivingly couples the drive shaft to the pistons such that the rotating motion of the drive shaft is converted into reciprocating motion of the pistons. The coupling mechanism includes a slant plate having a surface disposed at an adjustable inclined angle relative to a plane perpendicular to the drive shaft. The inclined angle of the slant plate is adjustable to vary the stroke length of the pistons in the cylinders and to thereby vary the capacity of the compressor. A passageway is formed in the housing and links the crank chamber and the suction chamber in fluid communication.

The compressor further includes a safety valve device for preventing an abnormal pressure differential between the crank chamber and the suction chamber, and a capacity control device for varying the capacity of the compressor by adjusting the inclined angle. The capacity control device includes an externally controlled valve mechanism which is disposed in the passageway. The externally controlled valve mechanism controls the opening and closing of the passageway in response to changes in a plurality of external signals which thereby control the capacity of the compressor. The safety valve device is provided within the externally controlled valve mechanism in order to open the passageway when a pressure differential between the crank chamber and the suction chamber exceeds a predetermined value.

DETAILED DESCRIPTION OF THE PREFERRED EMBODIMENTS

Figure 1:
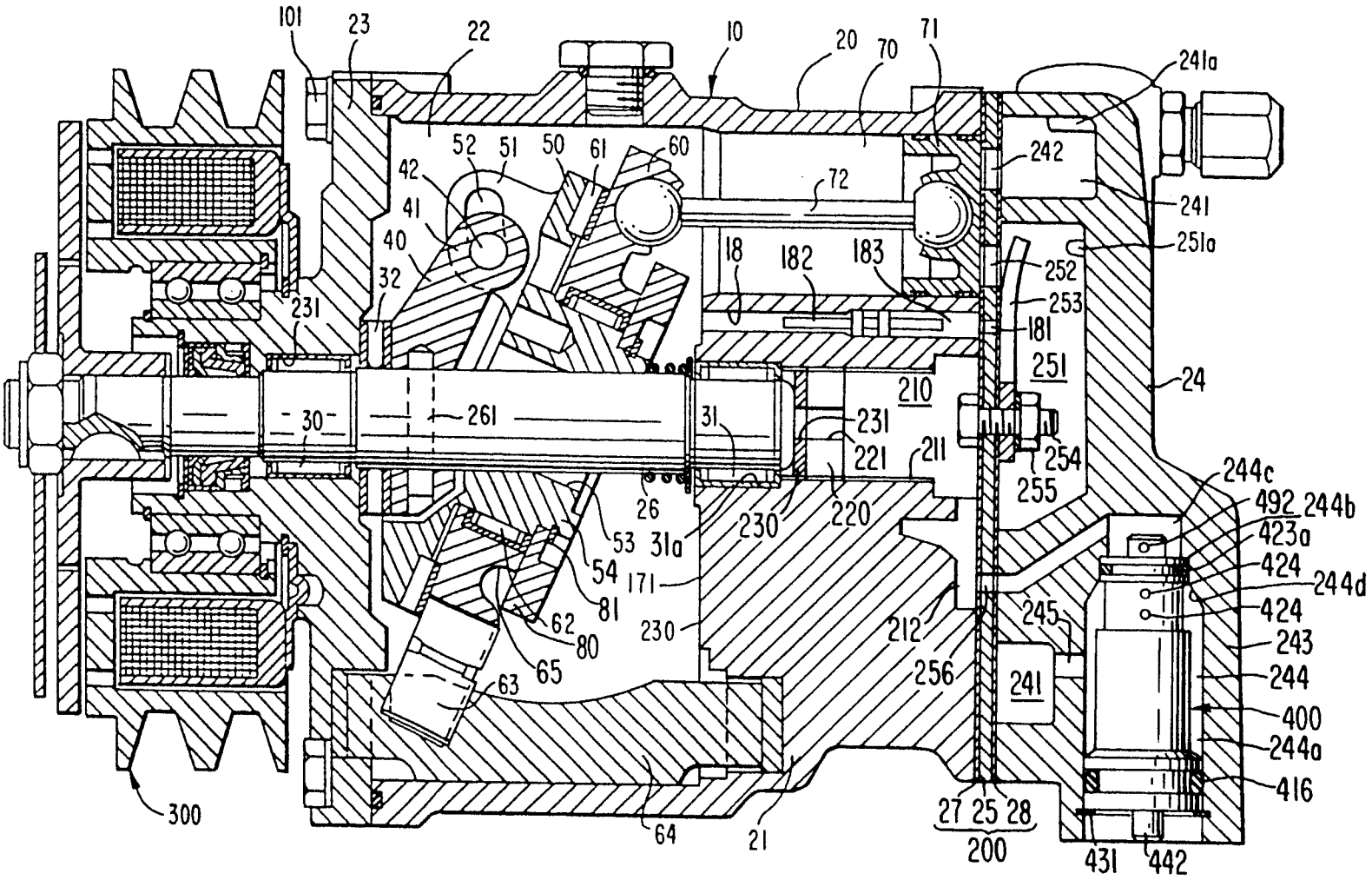
FIG. 1 is a vertical longitudinal sectional view of a slant plate type refrigerant compressor including a capacity control mechanism according to a first embodiment of this invention.
Figure 5:
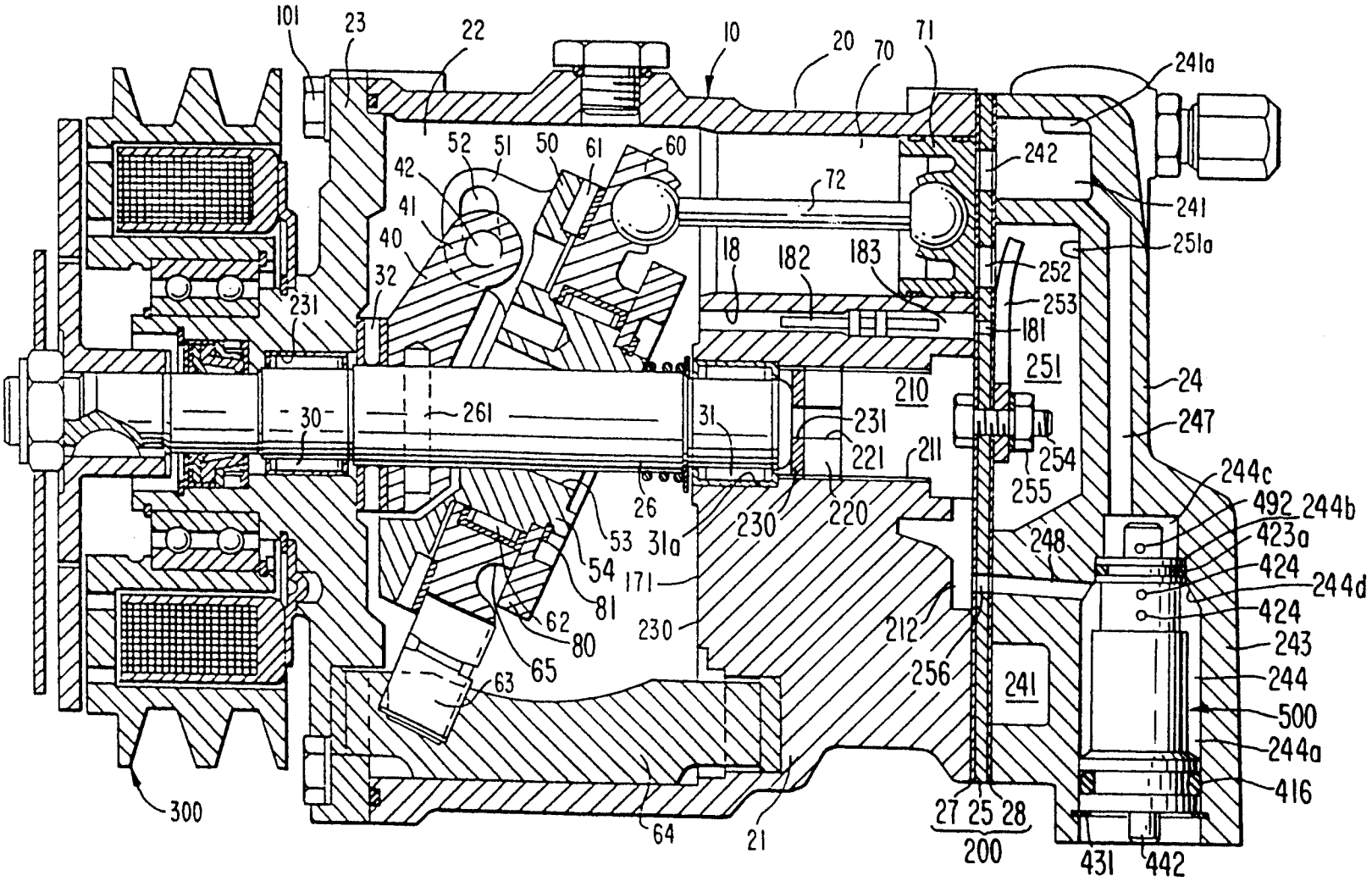
FIG. 5 is a vertical longitudinal sectional view of a slant plate type refrigerant compressor including a capacity control mechanism according to a second embodiment of this invention.

In FIGS. 1 and 5, for purpose of explanation only, the left side of the figures will be referenced as the forward end or front of the compressor, and the right side of the figures will be referenced as the rearward end or rear of the compressor.

With reference to FIG. 1, the construction of a slant plate type compressor, and more specifically a wobble plate type refrigerant compressor 10, having a capacity control mechanism in accordance with a first embodiment of the present invention is shown. Compressor 10 includes cylindrical housing assembly 20 including cylinder block 21, front end plate 23 disposed at one end of cylinder block 21, crank chamber 22 enclosed within cylinder block 21 by front end plate 23, and rear end plate 24 attached to the other end of cylinder block 21. Front end plate 23 is mounted on cylinder block 21 forward of crank chamber 22 by a plurality of bolts 101. Rear end plate 24 is also mounted on cylinder block 21 at the opposite end by a plurality of bolts (not shown). Valve plate 25 is located between rear end plate 24 and cylinder block 21. Opening 231 is centrally formed in front end plate 23 for supporting drive shaft 26 by bearing 30 disposed therein. The inner end portion of drive shaft 26 is rotatably supported by bearing 31 disposed within central bore 210 of cylinder block 21. Bore 210 extends to a rear end surface of cylinder block 21.

Bore 210 includes thread portion 211 formed at an inner peripheral surface of a central region thereof. Adjusting screw 220 having a hexagonal central hole 221 is screwed into thread portion 211 of bore 210. Circular disc-shaped spacer 230 having central hole 259 is disposed between the inner end surface of drive shaft 26 and adjusting screw 220. Axial movement of adjusting screw 220 is transferred to drive shaft 26 through spacer 230 so that all three elements move axially within bore 210. The above-mentioned construction and functional manner are described in detail in U.S. Pat. No. 4,948,343 to Shimizu.

Cam rotor 40 is fixed on drive shaft 26 by pin member 261 and rotates with drive shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53. Drive shaft 26 is disposed through opening 53. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to a plane perpendicular to the longitudinal axis of drive shaft 26. A balance weight ring 80 having a substantial mass is disposed on a nose of hub 54 of slant plate 50 in order to balance the slant plate 50 under dynamic operating conditions. Balance weight ring 80 is held in place by means of retaining ring 81.

Wobble plate 60 is nutatably mounted on hub 54 of slant plate 50 through bearings 61 and 62 which allow slant plate 50 to rotate with respect to wobble plate 60. Fork-shaped slider 63 is attached to the radially outer peripheral end of wobble plate 60 and is slidably mounted about sliding rail 64 disposed between front end plate 23 and cylinder block 21. Fork-shaped slider 63 prevents the rotation of wobble plate 60 such that wobble plate 60 nutates along rail 64 when cam rotor 40, slant plate 50 and balance weight ring 80 rotate. Undesirable axial movement of wobble plate 60 on hub 54 of slant plate 50 is prevented by contact between a rear end surface of inner annular projection 65 of wobble plate 60 and a front end surface of balance weight ring 80. Cylinder block 21 includes a plurality of peripherally located cylinder chambers 70 in which pistons 71 are disposed. Each piston 71 is connected to wobble plate 60 by a corresponding connecting rod 72. Accordingly, nutation of wobble plate 60 thereby causes pistons 71 to reciprocate within their respective chambers 70.

Rear end plate 24 includes peripherally located annular suction chamber 241 and centrally located discharge chamber 251. Valve plate 25 includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion 241*a* which is connected to an evaporator (not shown) of the external cooling circuit. Discharge chamber 251 is provided with outlet portion 251*a* connected to a condenser (not shown) of the cooling circuit. Gaskets 27 and 28 are located between cylinder block 21 and the inner surface of valve plate 25 and between the outer surface of valve plate 25 and rear end plate 24, respectively, to seal the mating surfaces of cylinder block 21, valve plate 25 and rear end plate 24. Gaskets 27 and 28 and valve plate 25 thus form valve plate assembly 200. A steel valve retainer 253 is fixed on a central region of the outer surface of valve plate 25 by bolt 254 and nut 255. Valve retainer 253 prevents excessive bend of the reed valve which is provided at discharge port 252 during a compression stroke of piston 71.

Conduit 18 is axially bored through cylinder block 21 so as to link crank chamber 22 to discharge chamber 251 through hole 181 which is axially bored through valve plate assembly 200. A throttling device such as orifice tube 182, is fixedly disposed within conduit 18. Filter member 183 is disposed in conduit 18 at the rear of orifice tube 182. Accordingly, a portion of the discharged refrigerant gas in discharge chamber 251 always flows into crank chamber 22 with a reduced pressure generated by orifice tube 182. The above-mentioned construction and functional manner are described in detail in Japanese Patent Application Publication No. 1-142277.

Rear end plate 24 further includes bulged portion 243 radially extending from a central region to a radial end thereof. Cylindrical cavity 244 is formed in bulged portion 243 so as to accommodate capacity control mechanism 400 which is further discussed below. One end of cavity 244 is open to the external environment outside of the compressor, that is, to atmospheric conditions.

Figure 2:
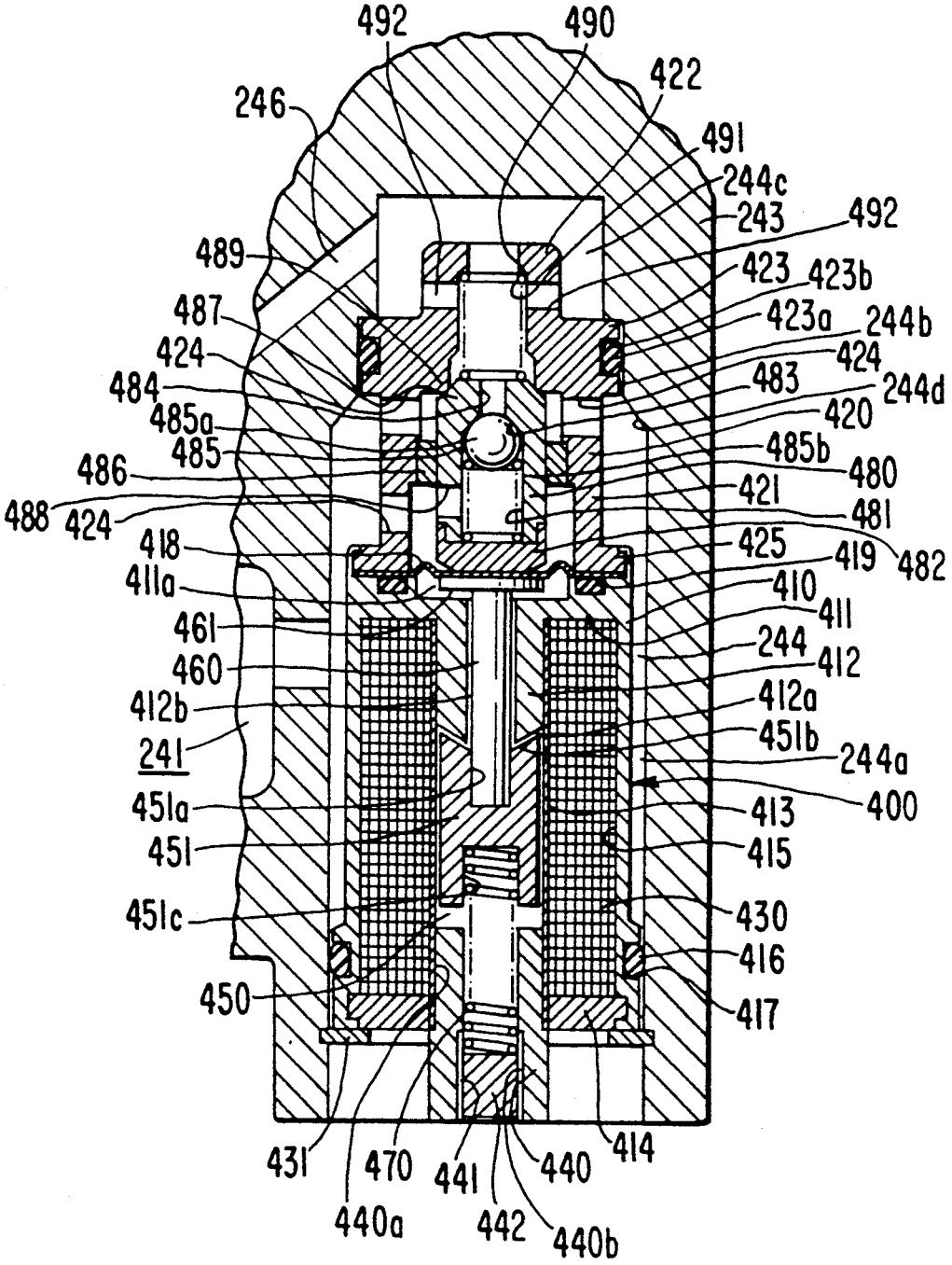
FIG. 2 is an enlarged partial sectional view of the capacity control mechanism shown in FIG. 1.

With reference to FIG. 2 additionally, cylindrical cavity 244 includes large, intermediate, and small diameter portions 244*a*, 244*b* and 244*c*, respectively, which thereby from an axial outer end thereof. The diameter of intermediate diameter portion 244*b* is smaller than the diameter of large diameter portion 244*a*, and is greater than the diameter of small diameter portion 244*c*. Large diameter portion 244*a* is linked to intermediate diameter portion 244*b* through truncated cone portion 244*d*. Large diameter portion 244*a* of cavity 244 is linked to suction chamber 241 through conduit 245 which is formed in rear end plate 24. Conduit 246 is also formed in rear end plate 24 so as to link small diameter portion 244*c* of cavity 244 to hole 256 which is formed in valve plate assembly 200. Hole 256 is linked to central bore 210 through conduit 212 which is formed in the rear portion of cylinder block 21. Central bore 210 is linked to crank chamber 22 through gap 31*a* created between bearing 31 and the inner peripheral surface of central bore 210, hole 231 of spacer 230 and hole 221 of adjusting screw 220. Accordingly, small diameter portion 244*c* of cavity 244 is linked to crank chamber 22 via conduit 246, hole 256, conduit 212, central bore 210, hole 221, hole 231 and gap 31*a*.

Capacity control mechanism 400 includes a first annular cylindrical casing 410 of magnetic material accommodated in large diameter portion 244*a* of cavity 244 and a second annular cylindrical casing 420 having a large diameter section 421 and a small diameter section 422 which extends upwardly from a top end of large diameter section 421. Large diameter section 421 of second annular cylindrical casing 420 is fixedly disposed at a top end of first annular cylindrical casing 410. The top end of small diameter section 422 of second annular cylindrical casing 420 terminates at a point approximately half the lenght of small diameter portion 244*c* of cavity 244. Annular protrusion 423 is formed at a boundary between large and small diameter sections 421 and 422 of second annular cylindrical casing 420, and is disposed within intermediate diameter portion 244*b* of cavity 244. An O-ring seal element 423*a* is disposed in an annular groove 423*b* formed at the outer peripheral surface of annular protrusion 423 so as to seal the mating surfaces between the outer peripheral surface of annular protrusion 423 and the inner peripheral surface of intermediate diameter portion 244*b* of cavity 244. Thus, small diameter portion 244*c* of cavity 244 is sealingly insulated from large diameter portion 244*a* of cavity 244.

First annular cylindrical casing 410 includes an annular flange 411, which radially and inwardly extends from the top portion of first annular cylindrical casing 410, and an axial annular projection 412 which axially and downwardly extends from an inner peripheral end portion of annular flange 411. Axial annular projection 412 terminates at a point approximately one-third of the length of first annular cylindrical casing 410, and includes a tapered bottom end surface 412*a*. Cylindrical pipe member 413, the length of which is a little less than the length of first annular cylindrical casing 410, is disposed in first annular cylindrical casing 410. An upper end portion of cylindrical pipe member 413 is fixedly attached to the outer peripheral surface of axial annular projection 412 by forcible insertion. Annular disc plate 414 is fixedly disposed at a bottom end of first annular cylindrical casing 410 to define an annular cavity 415 formed in cooperation with cylindrical pipe member 413 and first annular cylindrical casing 410. Electromagnetic coil 430 is fixedly disposed within annular cavity 415. Annular cylindrical pedestal 440 is disposed at the bottom portion of cylindrical pipe member 413. The upper half portion of pedestal 440 is fixedly attached to an inner peripheral surface of the bottom portion of cylindrical pipe member 413 by forcible insertion.

A vacant space 450 is defined by cylindrical pipe member 413, annular cylindrical pedestal 440 and axial annular projection 412 of first annular cylindrical casing 410. Cylindrical member 451 of magnetic material is axially and movably disposed in vacant space 450. Cylindrical rod 460 having circular disc plate 461 at its top end loosely penetrates through axial annular projection 412. The bottom end portion of rod 460 is fixedly received in cylindrical hole 451*a* formed in the top end surface of cylindrical member 451 through forcible insertion. Cylindrical member 451 includes tapered top end surface 451*b* which is parallel to the tapered bottom end surface 412*a* of axial annular projection 412. Annular cylindrical pedestal 440 includes a thread portion 441 formed in the inner peripheral surface of the lower half portion thereof. Adjusting screw 442 is screwed into thread portion 441 formed in the inner peripheral surface of the lower half of annular cylindrical pedestal 440. First coil spring 470 is disposed between adjusting screw 442 and the top end surface of cylindrical hole 451*c* which is formed at the bottom end surface of cylindrical member 451. The restoring force of first coil spring 470 urges cylindrical member 451 upwardly, thereby urging rod 460 upwardly. The restoring force of first coil spring 470 is adjusted by changing in the axial position of adjusting screw 442.

When electromagnetic coil 430 is energized, an electromagnetic force which tends to move cylindrical member 451 upwardly is induced. The magnitude of the electromagnetic force is directly proportional to the amperage of an electric current that is supplied to electromagnetic coil 430 from an electric circuit (not shown). The electric circuit receives a signal representing the heat load on the evaporator, such as the temperature of air immediately before passing through the evaporator, and the signal representing the amount of demand for acceleration of the automobile, such as the magnitude of force stepping on the accelerator. After processing the two signals, an electric current is supplied from the electric circuit to electromagnetic coil 430 in response to changes in the values of the two signals. The amperage of the electric current is continuously varied within the range from zero ampere to a predetermined maximum amperage, for example, 1.0 ampere.

More precisely, when the heat load on the evaporator is excessively large, such that the temperature of air immediately before passing through the evaporator is excessively high, and when the amount of demand for acceleration of the automobile is small, an electric current having zero ampere, i.e., no electric current, is supplied from the electric circuit to the electromagnetic coil 430 after the processing of the two signals through the electric circuit. However, when the amount of demand for acceleration of the automobile exceeds a predetermined value, the signal representing the demand for acceleration overrides the signal representing the heat load on the evaporator in the processing of the two signals by the electric circuit. As a result, an electric current having the predetermined maximum amperage is supplied from the electric circuit to the electromagnetic coil 430 even though the heat load on the evaporator is excessively large. Furthermore, when the heat load on the evaporator is excessively small, such as when the temperature of air immediately before passing through the evaporator is excessively low, an electric current having the predetermined maximum amperage is supplied from the electric circuit to the electromagnetic coil 430 without regard to the amount of demand for acceleration of the automobile.

O-ring seal element 416 is disposed in annular groove 417 formed in the outer peripheral surface of the bottom end portion of first annular cylindrical casing 410, to thereby seal the mating surfaces between the outer peripheral surface of first annular cylindrical casing 410 and the inner peripheral surface of large diameter portion 244*a* of cavity 244. Thus, large diameter portion 244*a* of cavity 244 is sealingly insulated from the ambient atmosphere outside of the compressor. Snap ring 431 is fixedly disposed at the bottom end of the inner peripheral surface of cavity 244 so as to prevent capacity control mechanism 400 from falling out of cavity 244.

Valve member 480 is disposed in the inner space of large diameter section 421 of second annular cylindrical casing 420. First axial hole 481 is centrally formed in valve member 480 and is open through to the bottom end of valve member 480. Valve member 480 is provided with circular plate 482 fixedly disposed at the bottom end thereof so as to close the bottom opening of first axial hole 481. First axial hole 481 terminates after extending approximately two-thirds of the length through valve member 480. The diameter of the terminal end portion of first axial hole 481 gradually decreases upwardly so as to form a valve seat 483. Second axial hole 484 having a diameter smaller than the diameter of first axial hole 481, is centrally formed in the top portion of valve member 480 so as to link first axial hole 481 to the interior space of small diameter section 422 of second annular cylindrical casing 420. Ball member 485*a* is elastically supported by a second coil spring 485*b*, the bottom end thereof being disposed at circular plate 482 such that ball member 485*a* is urged upwardly by virtue of the restoring force of second coil spring 485*b*. In a preferred embodiment of the invention, ball member 485*a* and second coil spring 485*b* substantially form safety valve device 485, as further discussed below. Annular ring member 486, through which valve member 480 slidably moves in the axial direction is fixedly disposed at the inner peripheral surface of large diameter section 421 of second annular cylindrical casing 420 by forcible insertion. Valve member 480 includes a truncated cone portion 487 formed at the top end thereof. Radial hole 488 is formed in a side wall of valve member 480 so as to link the inner space of large diameter section 421 of second annular cylindrical casing 420 to first axial hole 481 of valve member 480. A plurality of radial holes 424 are formed in large diameter section 421 of second annular cylindrical casing 420 so as to link large diameter portion 244*a* of cavity 244 to the interior region of large diameter sectin 421 of second annular cylindrical casing 420.

First annular ridge 489 is formed in the inner peripheral surface of annular casing 420 at the boundary between large and small diameter sections 421 and 422 of annular casing 420. First annular ridge 489 functions as a valve seat which truncated cone portion 487 of valve member 480 contacts. Second annular ridge 490 is formed in a top portion of the inner peripheral surface of small diameter section 422 of annular casing 420 by reducing the inner diameter thereof. Third coil spring 491 is disposed within the inner space of small diameter section 422. The top end of third coil spring 491 contacts second annular ridge 490 and the bottom end of third coil spring 491 contacts the flat top surface of valve member 480. Therefore, valve member 480 is urged downwardly by the restoring force of third coil spring 491. A plurality of radial holes 492 are formed in small diameter section 422 of second annular cylindrical casing 420 so as to link small diameter portion 244*c* of cavity 224 to the interior region of small diameter section 422 of second annular cylindrical casing 420.

Diaphragm 418 is disposed between disc plate 461 of rod 460 and circular plate 482 of valve member 480. The top surface of the central region of diaphragm 418 is maintained in contact with the bottom surface of circular plate 482 of valve member 480 by virtue of the restoring force of third coil spring 491. Similarly, the bottom surface of the central region of diaphragm 418 is maintained in contact with the top surface of disc plate 461 of rod 460 by virtue of the restoring of first coil spring 470.

An outer peripheral portion of diaphragm 418 is sandwiched between annular flange 411 of first annular cylindrical casing 410 and flange 425 which radially and outwardly extends from the bottom end of second annular cylindrical casing 420. O-ring seal element 419 is disposed between the top end surface of flange 411 of casing 410 and the bottom end surface of the outer peripheral portion of diaphragm 418 to thereby effectively seal the mating surfaces therebetween.

Indent 411*a* is formed at the top end surface of the inner peripheral portion of annular flange 411 of casing 410 such that indent 411*a* faces the bottom end surface of diaphragm 418. Indent 411*a* is linked to the ambient atmosphere outside of the compressor via the gap 412*b* created between rod 460 and annular projection 412, vacant space 450, the gap 440*a* created between pedestal 440 and pipe member 413, and the gap 440*b* created between pedestal 440 and adjusting screw 442. Thus, the bottom end surface of diaphragm 418 is in communication with and thereby receives air at atmospheric pressure.

Similarly, the interior region of the large diameter section 421 of second casing 420 is linked to suction chamber 241 via holes 424, large diameter portion 244*a* of cavity 244, and conduit 245. Thus, the top end surface of diaphragm 418 is in communication with and thereby receives the refrigerant at the suction chamber pressure.

During operation of compressor 10, drive shaft 26 is rotated by the engine of the automobile through electromagnetic clutch 300. Cam rotor 40 is rotated with drive shaft 26, thereby rotating slant plate 50 as well, which in turn causes wobble plate 60 to nutate. The nutational motion of wobble plate 60 then reciprocates pistons 71 in their respective cylinders 70. As pistons 71 are reciprocated, refrigerant gas is introduced into suction chamber 241 through inlet portion 241*a*, flows into each cylinder 70 through suction ports 242, and is then compressed. The compressed refrigerant gas is then discharge to discharge chamber 251 from each cylinder 70 through discharge ports 252, and continues therefrom into the cooling circuit through outlet portion 251*a*.

The capacity of compressor 10 is adjusted in order to maintain a constant pressure in suction chamber 241, irrespective of the changes in the heat load on the evaporator or the rotating speed of the compressor. The capacity of the compressor is adjusted by changing the angle of the slant plate, which is dependent upon the crank chamber pressure, or more precisely, which is dependent upon the differential between the crank chamber and the suction chamber pressures. During the operation of compressor 10, the pressure of the crank chamber increases due to blow-by gas flowing past pistons 71 as they reciprocate in cylinders 70. As the crank chamber pressure increases relative to the suction chamber pressure, the slant angle of slant plate 50 as well as the slant angle of wobble plate 60 decrease, thereby decreasing the capacity of the compressor. Likewise, a decrease in the crank chamber pressure relative to the suction chamber pressure causes an increase in the angle of slant plate 50 and wobble plate 60, and thus an increase in the capacity of the compressor.

Figure 3:
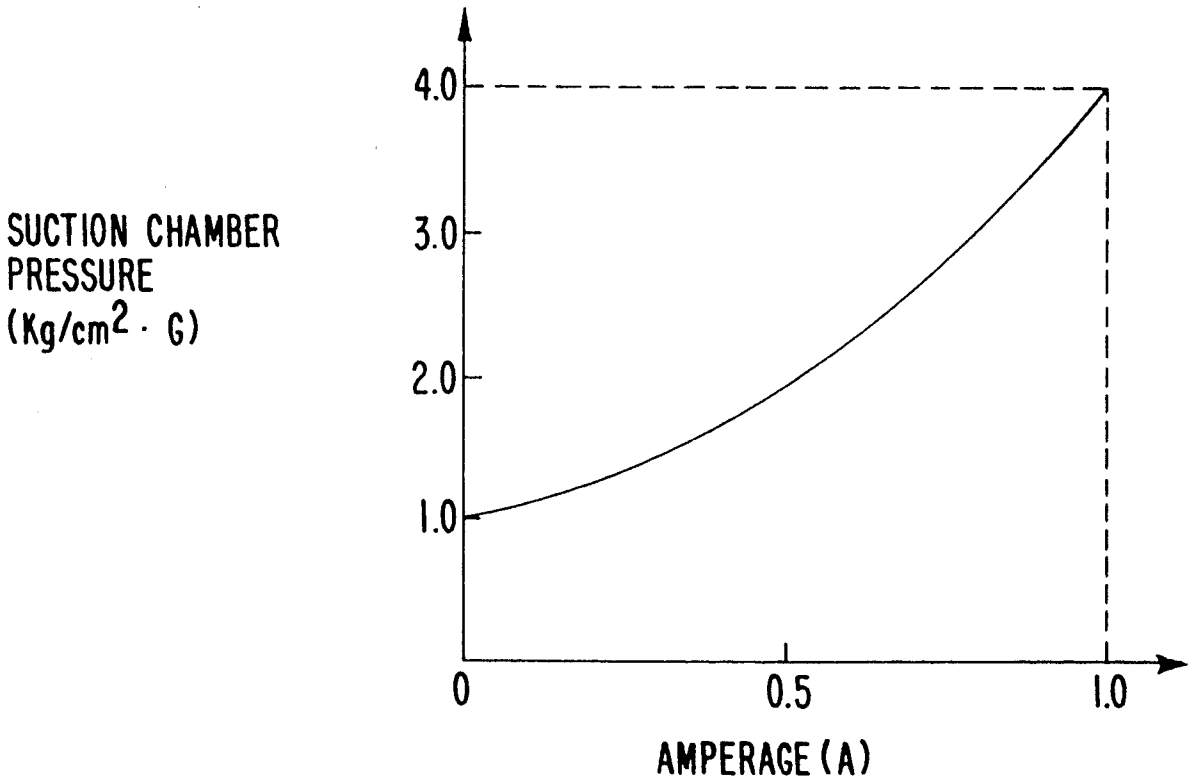
FIG. 3 is a graph showing the relationship between the amperage of an electric current supplied from an electric circuit to an electromagnetic coil and the corresponding suction chamber pressure at which the upward and downward forces acting on a diaphragm are balanced.

The operation of capacity control mechanism 400 of compressor 10 in accordance with the first embodiment of the present invention is carried out in the following manner. With reference to FIGS. 1-3, when the heat load on the evaporator is excessively large and concurrently therewith the amount of demand for acceleration of the automobile is small, no electric current is supplied from the electric circuit to the electromagnetic coil 430. As a result, diaphragm 418 is urged upwardly only by virtue of the restoring force of first coil spring 470 and the atmospheric pressure force acting on the bottom end surface of diaphragm 418. Under such conditions, valve member 480 is situated so as to maintain an opening for communication between small diameter portion 244*c* of cavity 244 and large diameter portion 244*a* of cavity 244. Valve member 480 maintains such a position until the suction chamber pressure drops to a first predetermined value, for example 1.0 kg/cm$^2$ G, at which time the upward and downward forces acting on diaphragm 418 will be balanced. Thus, slant plate 50 and wobble plate 60 are disposed at a maximum slant angle with respect to the plane perpendicular to the longitudinal axis of drive shaft 26 due to an opening for fluid communication between crank chamber 22 and suction chamber 241; and accordingly, compressor 10 operates in a maximum capacity displacement until the suction chamber pressure drops to the first predetermined value. Once the suction chamber pressure drops to the first predetermined value, the slant angle of slant plate 50 and wobble plate 60 is adjusted in response to the changes in the heat load on the evaporator in order to thereby maintain the suction chamber pressure at the first predetermined value.

On the other hand, when the heat load on the evaporator is excessively small, an electric current having a predetermined maximum amperage is supplied from the electric circuit to the electromagnetic coil 430 without regard to the amount of demand for acceleration of the automobile. As a result, diaphragm 418 is urged upwardly by virtue of the restoring force of first coil spring 470, a predetermined maximum electromagnetic force induced by electromagnetic coil 430, and the atmospheric pressure force acting on the bottom end surface of diaphragm 418. Valve member 480 thus moves upwardly so as to close the fluid communication opening between small diameter portion 244*c* of cavity 244 and large diameter portion 244*a* of cavity 244. Valve member 480 maintains such a position until the suction chamber pressure rises to a second predetermined value, for example 4.0 kg/cm$^2$ G, at which time the upward and downward forces acting on diaphragm 418 are balanced. Therefore, slant plate 50 and wobble plate 60 are disposed at a minimum slant angle with respect to the plane perpendicular to the longitudinal axis of drive shaft 26 due to the block in fluid communication between crank chamber 22 and suction chamber 241; and accordingly, compressor 10 operates at a minimum capacity displacement until the suction chamber pressure rises to the second predetermined value. Once the suction chamber pressure rises to the second predetermined value, the slant angle of slant plate 50 and wobble plate 60 is adjusted in response to the changes in the heat load on the evaporator in order to thereby maintain the suction chamber pressure at the second predetermined value.

Furthermore, since the amperage of the electric current supplied from the electric circuit to electromagnetic coil 430 is continuously varied within the range from zero to the predetermined maximum value in response to the changes in the value of the aforementioned two signals, the location of valve member 480 is likewise continuously varied in response to these amperage changes. Therefore, as shown in FIG. 3, the suction chamber pressure at which the upward and downward forces acting on diaphragm 418 are balanced is also continuously varied within the range defined by the first and second predetermined values. Thus, the angular position of slant plate 50 and wobble plate 60 is continuously varied within a range defined by the maximum and minimum slant angles and the capacity displacement of compressor 10 is similarly varied within a range defined by the maximum and the minimum values thereof.

According to the above-mentioned manner of operation for capacity control mechanism 400, the capacity displacement of compressor 10 is adjusted to maintain a predetermined constant pressure in suction chamber 241.

Furthermore, when the demand for acceleration of the automobile exceeds the predetermined value at a time when the suction chamber pressure is being maintained at the first predetermined value, i.e., 1.0 kg/cm$^2$ G, the angular position of slant plate 50 and wobble plate 60 is forcibly changed to, and then is maintained at the minimum slant angle until the suction chamber pressure rises to the second predetermined value, i.e., 4.0 kg/cm$^2$ G. This maximally reduces the energy consumption by the compressor, the driving force which is derived from the automobile engine, and thereby assists in providing the acceleration that is demanded.

In other words, in a situation where electromagnetic coil 430 is receiving an electric current having zero ampere or approximate zero ampere from the electric circuit is suddenly changed such that electromagnetic coil 430 is receiving an electric current having the predetermined maximum amperage, i.e., 1.0 ampere from the electric circuit, the location of valve member 480 is forcibly moved and then maintained so as to close the fluid communication opening between small diameter portion 244c of cavity 244 and large diameter portion 244a of cavity 244, until such a time that the suction chamber pressure rises to the second predetermined value, i.e., 4.0 kg/cm$^2$ G.

Figure 4:
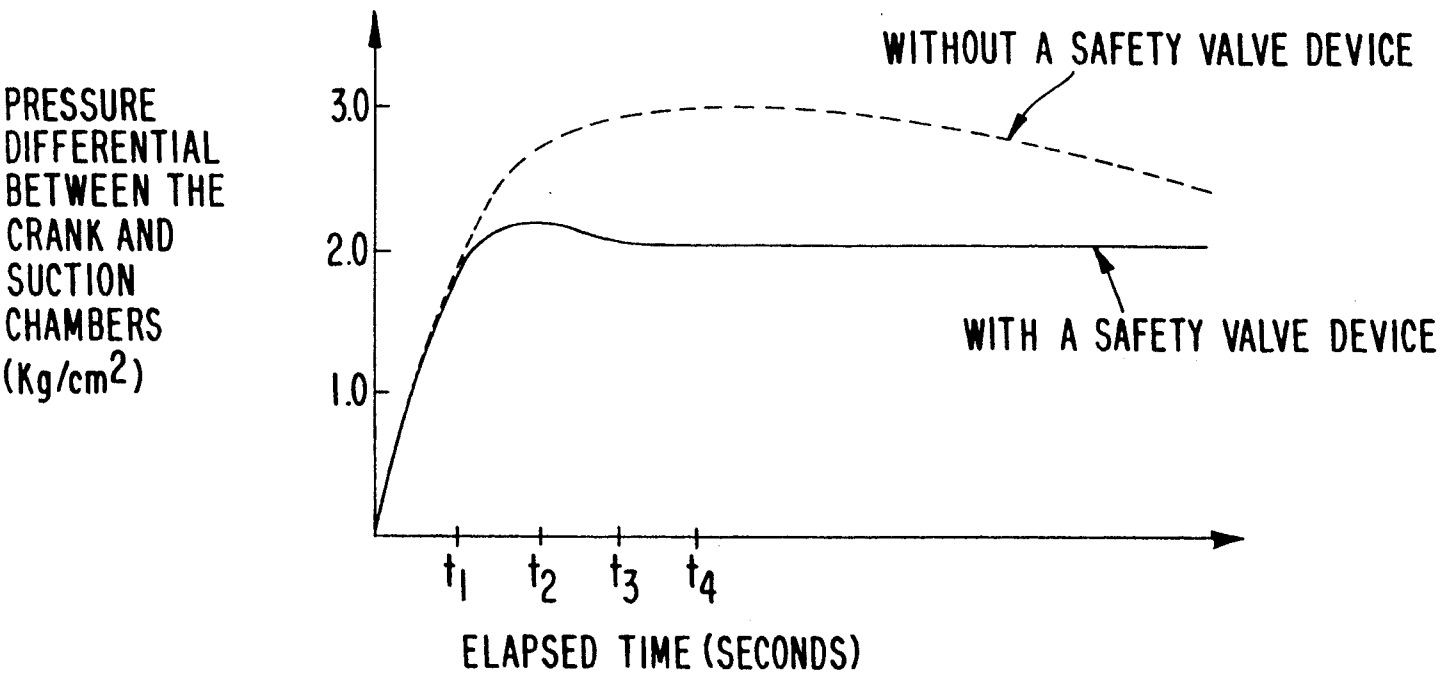
FIG. 4 is a graph showing the changes in pressure differential between the crank and suction chambers over a period of time after the supply of electric current having a predetermined maximum amperage from an electric circuit to an electromagnetic coil is initiated.

As a result, the block in fluid communication between crank chamber 22 and suction chamber 241 is maintained for a long time period. If a safety valve device, such as discussed in the description of the prior art, is not provided in the compressor, this long time period of a block in the fluid communication between crank chamber 22 and suction chamber 241 causes an abnormal rise in the crank chamber pressure due to the conduction of the refrigerant gas from discharge chamber 251 to crank chamber 22 through conduit 18 having orifice tube 182. and blow-by gas leaking past pistons 71 in cylinder chambers 70 as the pistons 71 reciprocate. Thus, the pressure differential between the crank chamber 22 and the suction chamber 241 becomes excessively large, as shown by the dashed line in FIG. 4, and a force excessively urging wobble plate 60 rearwardly is generated. This excessive urging force on wobble plate 60 causes excessive rearward movement of wobble plate 60, and thereby results in excessive friction between the rear end surface of annular projection 65 of wobble plate 60 and the front end surface of balance weight ring 80, and between the inner end surface of drive shaft 26 and a front end surface of spacer 230 disposed in central bore 210. This excessive friction may in turn then cause a seizure between annular projection 65 of wobble plate 60 and balance weight ring 80 or between drive shaft 26 and spacer 230.

In order to resolve the above defect, capacity control mechanism 400 is provided with safety valve device 485 therein. Safety valve device 485 includes ball member 485a and second coil spring 485b which elastically supports ball member 485a. Safety valve device 485 functions in the following manner. Ball member 485a is urged downwardly by the crank chamber pressure received on the upper spherical surface thereof while also being urged upwardly by the restoring force of second coil spring 485b and the suction chamber pressure received on the lower spherical surface thereof. Safety valve device 485 is designed so as to open second axial hole 484 when the pressure differential between crank chamber 22 and suction chamber 241 rises to a predetermined value, for example, 2.0 kg/cm$^2$. Therefore, the crank chamber pressure is forcibly and quickly reduced so as to maintain the pressure differential between crank chamber 22 and suction chamber 241 at the predetermined value, i.e., 2.0 kg/cm$^2$, as shown by the solid line in FIG. 4, and thereby maintain the angular position of slant plate 50 and wobble plate 60 at the minimum slant angle even when the amperage of the electric current is suddenly increased from zero ampere to the predetermined maximum amperage. Thus, generation of an excessive force which urges wobble plate 60 rearwardly can be prevented and the resultant excessive friction between the rear end surface of annular projection 65 of wobble plate 60 and the front end surface of balance weight ring 80, and between the inner end surface of drive shaft 26 and the front end surface of spacer 230 disposed in central bore 210 can also be prevented. Furthermore, safety valve device 485 functions equally as well when the fluid communication opening between crank chamber 22 and suction chamber 241 is blocked for a long time period due to problems with the movement of valve member 480.

As discussed above, since capacity control mechanism 400 is provided with safety valve device 485 therein, the complicated process of forming an additional passageway for communicating crank chamber 22 with suction chamber 241 in cylinder block 21 and the process of disposing the safety valve device in the additional passageway, are thus eliminated. Therefore, according to the present invention, a compressor having an externally controlled capacity control mechanism and a safety valve device for preventing an abnormal pressure differential between the crank and suction chambers can be easily manufactured.

With reference to FIG. 5, a wobble plate type refrigerant compressor including a capacity control mechanism in accordance with a second embodiment of the present invention is shown. As illustrated, like reference numerals are used to denote like elements corresponding to those shown in FIGS. 1 and 2. Except where otherwise stated, the overall functioning of the compressor is the same as discussed above.

Figure 6:
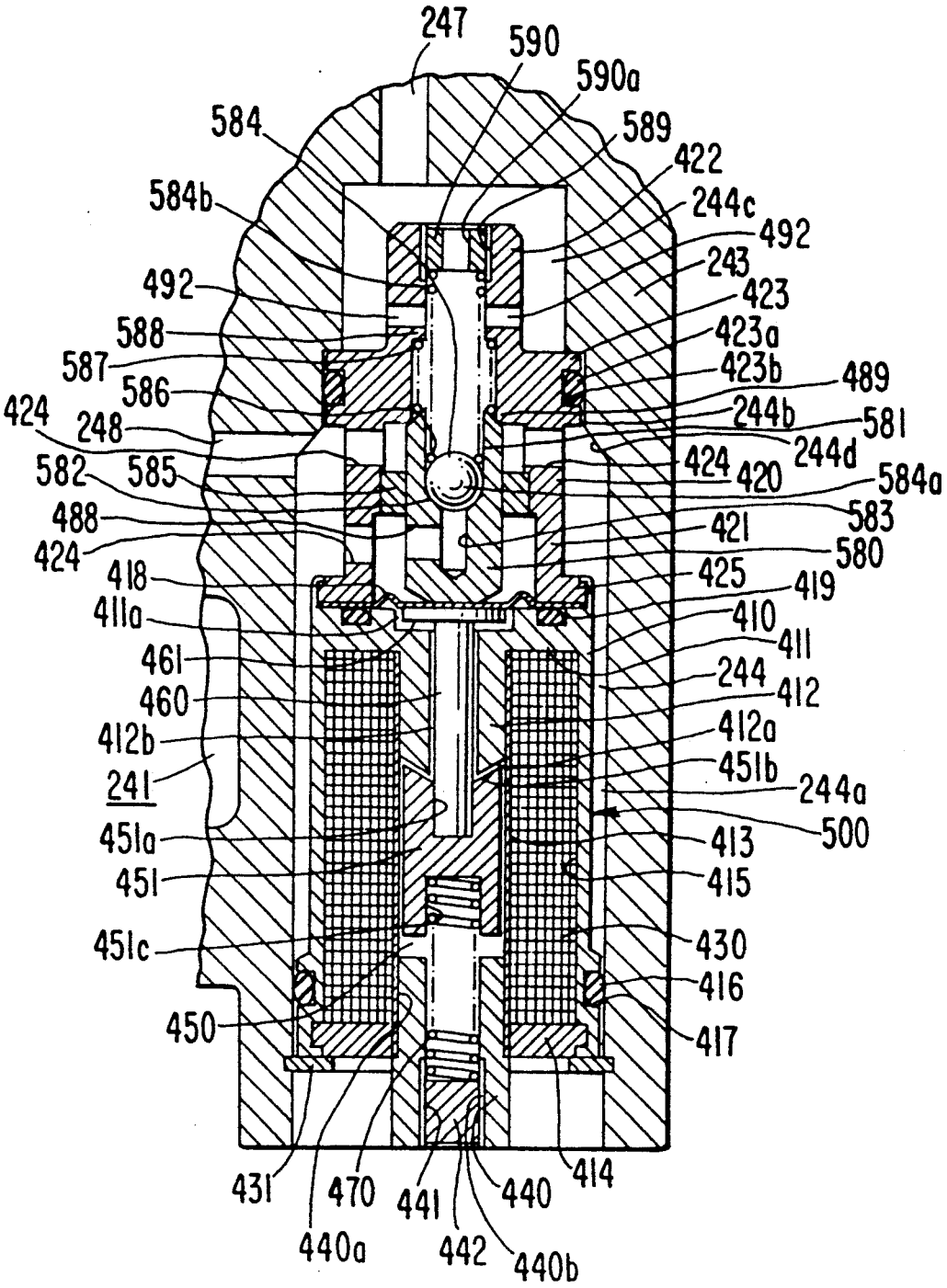
FIG. 6 is an enlarged partial sectional view of the capacity control mechanism shown in FIG. 5.

With reference to FIG. 6 in addition to FIG. 5, capacity control mechanism 500 of the wobble plate type refrigerant compressor includes a valve member 580 disposed in the interior region of large diameter section 421 of second annular cylindrical casing 420. First axial hole 581 is centrally formed in valve member 580, and is open through to the top end of valve member 580. First axial hole 581 terminates at a point corresponding to half of the length of valve member 580. The diameter of the terminal end portion of first axial hole 581 is gradually decreased downward so as to form a valve seat 582. Second axial hole 583, having a diameter smaller than the diameter of first axial hole 581, extends from the terminal end of first axial hole 581 to the bottom end portion of valve member 580. Ball member 584a is disposed in valve seat 582. Annular ring member 585, through which valve member 580 slidably moves along the longitudinal axis, is fixedly disposed at the inner peripheral surface of large diameter section 421 of second annular cylindrical casing 420 by forcible insertion. Valve member 580 includes a truncated cone portion 586 formed at the top end thereof. The inner space of large diameter section 421 of second annular cylindrical casing 420 is linked to second axial hole 583 of valve member 580 through radial hole 488.

Third coil spring 587 is elastically disposed between truncated cone portion 586 of valve member 580 and an annular ridge 588 which is formed at the inner peripheral surface of the boundary region between large and small diameter sections 421 and 422 of second annular cylindrical casing 420. Valve member 580 is urged downwardly by virtue of the restoring force of third coil spring 587.

Second annular cylindrical casing 420 further includes a thread portion 589 formed at the inner peripheral surface of the top end portion thereof. Adjusting screw 590 is screwed into thread portion 589 of second annular cylindrical casing 420. Axial hole 590a is formed through adjusting screw 590 so as to link small diameter portion 244c of cavity 244 to the interior region of small diameter section 422 of second annular cylindrical casing 420. Second coil spring 584b is disposed between adjusting screw 590 and an upper spherical surface of ball member 584a so as to urge ball member 584a downwardly by virtue of the restoring force of second coil spring 584b. The restoring force of second coil spring 584*b* is adjusted by the changes in the axial position of adjusting screw 590. Ball member 584*a* and second coil spring 584*b* substantially form safety valve device 584.

Conduit 247 is formed in rear end plate 24 so as to link small diameter portion 244*c* of cavity 244 to suction chamber 241. Conduit 248 is also formed in rear end plate 24 so as to link large diameter portion 244*a* of cavity 244 to hole 256.

In this second embodiment of the present invention, the interior region of the large diameter section 421 of second casing 420 is linked to crank chamber 22 via holes 424, large diameter portion 244*a* of cavity 244, conduit 248, hole 256, conduit 212, central bore 210, hole 221, hole 231 and gap 31*a*. Thus, the top end surface of diaphragm 418 is in communication with and thereby receives the refrigerant at the crank chamber pressure. Accordingly, the capacity of compressor 10 is adjusted to maintain a predetermined constant pressure in crank chamber 22, which in turn, also maintains a predetermined constant pressure in suction chamber 241, eventually.

This invention has been described in connection with preferred embodiments. These embodiments, however, are merely for example only and the invention is not restricted thereto. It will be understood by those skilled in the art that variations and modifications can easily be made within the scope of this invention as defined by the claims.

I claim:

1. In a slant plate type refrigerant compressor having a compressor housing enclosing a crank chamber, a suction chamber and a discharge chamber therein, said compressor housing comprising a cylinder block having a plurality of cylinders formed therethrough, a piston slidably fitted within each of said cylinders, drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate being adjustable to vary the stroke length of said pistons in said cylinders and to thereby vary the capacity of said compressor, a passageway formed in said housing and linking said crank chamber and said suction chamber in fluid communication, capacity control means for varying the capacity of the compressor by adjusting the inclined angle, and safety valve means for preventing an abnormal pressure differential between said crank chamber and said suction chamber, said capacity control means including externally controlled valve means for controlling the opening and closing of said passageway in response to changes in a plurality of external signals to control the link between said crank and said suction chambers and to thereby control the capacity of the compressor, said externally controlled valve means being disposed in said passageway, the improvement comprising:

said safety valve means being provided within said externally controlled valve means so as to open said passageway when the pressure differential between said crank chamber and said suction chamber exceeds a predetermined value.

2. The compressor of claim 1 wherein said safety valve means opens and closes said passageway in response to changes in the pressure differential between said crank chamber and said suction chamber.

3. The compressor of claim 1 wherein said externally controlled valve means includes a valve element which opens and closes said passageway and said safety valve means is disposed within said valve element.

4. The compressor of claim 1 wherein said plurality of external signals comprises a first signal representing a heat load on an evaporator which is an element of a cooling circuit including said compressor and a second signal representing an amount of demand for acceleration of an automobile.

5. A slant plate type refrigerant compressor comprising:

a compressor housing enclosing a crank chamber, a suction chamber and a discharge chamber;

said compressor housing including a cylinder block having a plurality of cylinders formed therethrough, a piston slidably fitted within each of said cylinders, and drive means coupled to said pistons for reciprocating said pistons within said cylinders;

said drive means including a drive shaft rotatably supported in said housing and coupling means for drivingly coupling said drive shaft to said pistons such that rotary motion of said drive shaft is converted into reciprocating motion of said pistons;

said coupling means including a slant plate having a surface disposed at an adjustable inclined angle relative to a plane perpendicular to said drive shaft;

a passageway formed in said housing and linking said crank chamber and said suction chamber in fluid communication;

capacity control means for varying the capacity of said compressor by adjusting the inclined angle of said slant plate;

said capacity control means including externally controlled valve means for controlling the opening and closing of said passageway; and safety valve means for preventing an abnormal pressure differential between said crank chamber and said suction chamber;

wherein said externally controlled valve means is disposed in said passageway;

wherein said safety valve means is disposed within said externally controlled valve means so as to open said passageway when the pressure differential between said crank chamber and said suction chamber exceeds a predetermined value;

wherein the inclined angle of said slant plate is adjusted to vary the stroke length of said pistons in said cylinders and to thereby vary the capacity of said compressor; and wherein said passageway is opened and closed in response to changes in a plurality of external signals which control the link between said crank chamber and said suction chamber, thereby controlling the adjustment of the inclined angle of said slant plate and the capacity of said compressor.

6. The compressor of claim 5 wherein said safety valve means opens and closes said passageway in response to changes in the pressure differential between said crank chamber and said suction chamber.

7. The compressor of claim 5 wherein said externally controlled valve means includes a valve element which opens and closes said passageway and said safety valve means is disposed within said valve element.

8. The compressor of claim 5 wherein said plurality of external signals comprises a first signal representing a heat load on an evaporator which is an element of a cooling circuit including said compressor and a second signal representing an amount of demand for acceleration of an automobile.

9. A variable displacement slant plate type compressor:

a compressor housing enclosing a crank chamber, a suction chamber and a discharge chamber;

said compressor housing including a cylinder block having a plurality of cylinders formed therethrough, a piston slidably fitted within each of said cylinders, and drive means coupled to said pistons for reciprocating said pistons within said cylinders;

said drive means including a drive shaft rotatably supported in said housing and coupling means for drivingly coupling said drive shaft to said pistons such that rotary motion of said drive shaft is converted into reciprocating motion of said pistons;

said coupling means including a slant plate having a surface disposed at an adjustable inclined angle relative to a plane perpendicular to said drive shaft;

a front end plate disposed on one end of said cylinder block and a rear end plate disposed on the other end of said cylinder block;

a cylindrical cavity having a first cavity portion and a second cavity portion formed in said rear end plate, one end of said cylindrical cavity communicating with the external environment;

a first passageway formed in said housing and linking in fluid communication one of said crank chamber and said suction chamber with said first cavity portion of said cylindrical cavity;

a second passageway formed in said housing and linking in fluid communication the other of said crank chamber and said suction chamber with said second cavity portion of said cylindrical cavity;

capacity control means disposed in said cylindrical cavity;

said capacity control means including externally controlled valve means for controlling fluid communication between said first cavity portion and second cavity portion, and thus between said suction chamber and said crank chamber, responsive to changes in a plurality of external signals such that the capacity of the compressor is thereby varied by adjusting the inclined angle of said slant plate; and safety valve means disposed within said externally controlled valve means so as to open communication between said first cavity portion and said second cavity portion when the pressure differential between said crank chamber and said suction chamber exceeds predetermined value, such that an abnormal pressure differential between said crank chamber and said suction chamber is thereby prevented.

10. The compressor of claim 9 wherein said plurality of external signals includes a first signal representing a heat load on an evaporator which is an element of a cooling circuit including said compressor and a second signal representing the amount of demand for acceleration of an automobile in which said compressor is disposed.

11. The compressor of claim 9 wherein said capacity control mechanism includes a first annular cylindrical casing made of magnetic material and a second annular cylindrical casing having a lower portion and an upper portion.

12. The compressor of claim 11 wherein an annular protrusion of said second annular cylindrical casing forms a sealed boundary between said first cavity portion and said second cavity portion of said cylindrical cavity.

13. The compressor of claim 12 wherein an electromagnetic coil is disposed within said first annular cylindrical casing.

14. The compressor of claim 13 wherein said externally controlled valve means includes a valve member disposed within said second annular cylindrical casing, said valve member having a first larger diameter axial hole and a second smaller diameter axial hole extending therefrom and communicating with the interior of said second annular cylindrical casing.

15. The compressor of claim 14 wherein said valve member further includes a first radial hole such that one of said first axial hole and said second axial hole is in fluid communication with an interior region of said lower portion of said second annular cylindrical casing.

16. The compressor of claim 15 wherein said lower portion of said second annular cylindrical casing includes a plurality of radial holes so as to link the interior region of said lower portion of said second annular cylindrical casing with said first cavity portion of said cylindrical cavity.

17. The compressor of claim 16 wherein said upper portion of said second annular casing cylindrical casing includes a plurality of radial holes so as to link in fluid communication the interior region thereof and said second cavity portion of said cylindrical cavity.

18. The compressor of claim 17 wherein said safety valve means includes a ball member elastically supported by a coil spring and disposed within said first axial hole of said valve member such that fluid communication between said first axial hole and said second axial hole is blocked.

19. The compressor of claim 18 wherein an upper surface of said ball member is in communication with and urged downwardly by the pressure in one of said suction chamber and said crank chamber while a lower surface of said ball member is in communication with and urged upwardly by the pressure in the other of said suction chamber and said crank chamber.

20. The compressor of claim 18 wherein said ball member opens said second axial hole thereby allowing fluid communication with said first axial hole when the pressure differential between said crank chamber and said suction chamber reaches a predetermined value.

21. The compressor of claim 17 wherein said valve member is moved so as to maintain a predetermined constant pressure in said suction chamber.

22. The compressor of claim 17 wherein said valve member is moved so as to maintain a predetermined constant pressure in said crank chamber.

* * * * *